US006267150B1

(12) United States Patent
Herring

(10) Patent No.: US 6,267,150 B1
(45) Date of Patent: Jul. 31, 2001

(54) PAPERMAKING FABRIC SEAM WITH ADDITIONAL THREADS IN THE SEAM AREA

(75) Inventor: Samuel H. Herring, Simpsonville, SC (US)

(73) Assignee: Asten Johnson, Inc., Charleston, SC (US)

( * ) Notice: Subject to any disclaimer, the term of this patent is extended or adjusted under 35 U.S.C. 154(b) by 0 days.

(21) Appl. No.: 09/384,535

(22) Filed: Aug. 27, 1999

Related U.S. Application Data

(60) Provisional application No. 60/098,547, filed on Aug. 31, 1998, provisional application No. 60/097,831, filed on Aug. 31, 1998, provisional application No. 60/098,566, filed on Aug. 31, 1998, provisional application No. 60/098,567, filed on Aug. 31, 1998, and provisional application No. 60/098,573, filed on Aug. 31, 1998.

(51) Int. Cl.[7] ..... D03D 13/00; D21F 1/00; D21F 7/10

(52) U.S. Cl. ..... 139/383 AA; 442/270; 428/58; 428/193

(58) Field of Search ..... 139/383 AA; 442/270; 428/58, 193; 162/904

(56) References Cited

U.S. PATENT DOCUMENTS

| | | | |
|---|---|---|---|
| 3,316,599 | 5/1967 | Wagner . | |
| 4,186,780 | 2/1980 | Josef et al. . | |
| 4,438,789 | 3/1984 | MacBean | 139/383 A |
| 4,601,785 | 7/1986 | Lilja et al. . | |
| 4,842,925 | 6/1989 | Dufour et al. . | |
| 4,979,543 | 12/1990 | Moriarty et al. . | |
| 5,188,884 | 2/1993 | Smith . | |
| 5,458,161 | 10/1995 | Scarfe . | |
| 5,476,123 | 12/1995 | Rydin . | |
| 5,531,251 | 7/1996 | Rydin . | |
| 5,799,709 | 9/1998 | Shipley . | |
| 5,913,339 | 6/1999 | Lee . | |

*Primary Examiner*—Andy Falik
(74) *Attorney, Agent, or Firm*—Volpe and Koenig, P.C.

(57) ABSTRACT

An open-ended papermaker's fabric of a type woven from a longitudinal thread system and a transverse thread system and including a plurality of seam loops at each end of the fabric. A seam zone exists at each end of the fabric between the respective seam loops and the last thread of the transverse thread system. At least one additional transverse thread is interwoven in at least one seam zone, with the transverse thread placed in a repeated pattern of over at least three adjacent paper side longitudinal threads, between at least a first pair of paper side and machine side threads, under at least one machine side longitudinal thread, and between at least a second pair of machine and paper side threads.

13 Claims, 8 Drawing Sheets

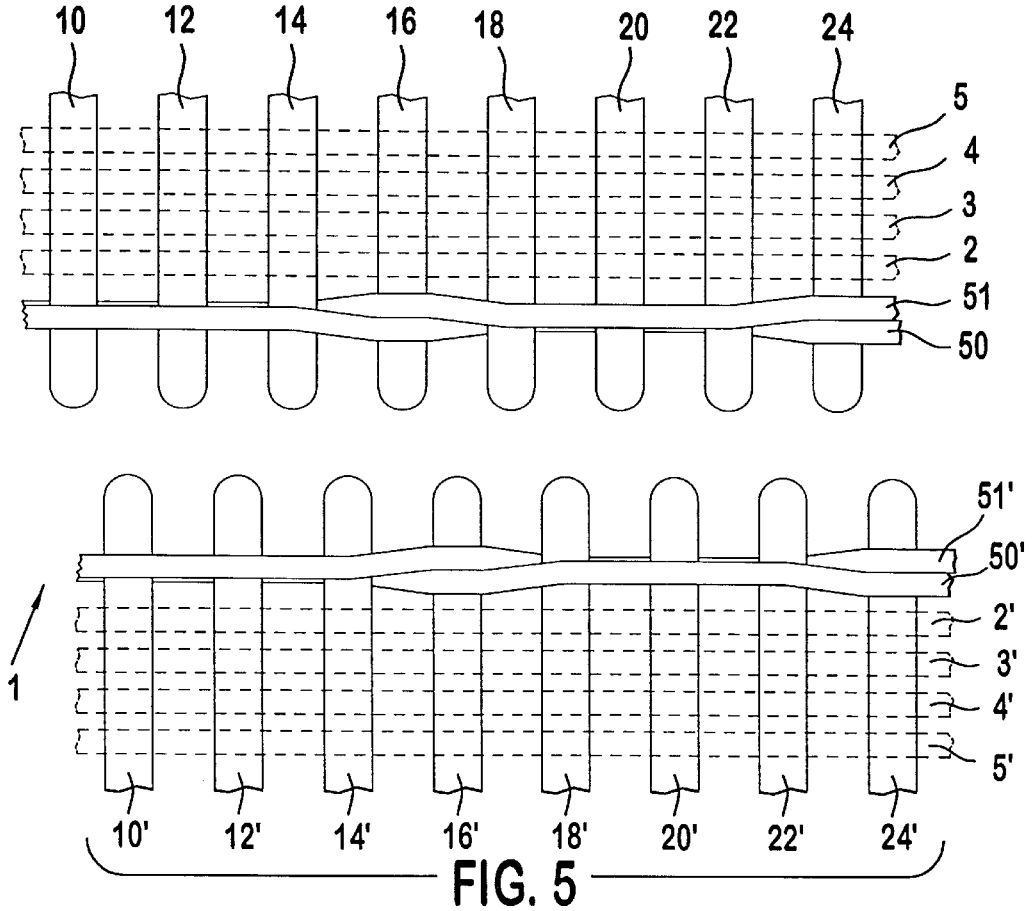
FIG. 5
FIG. 6
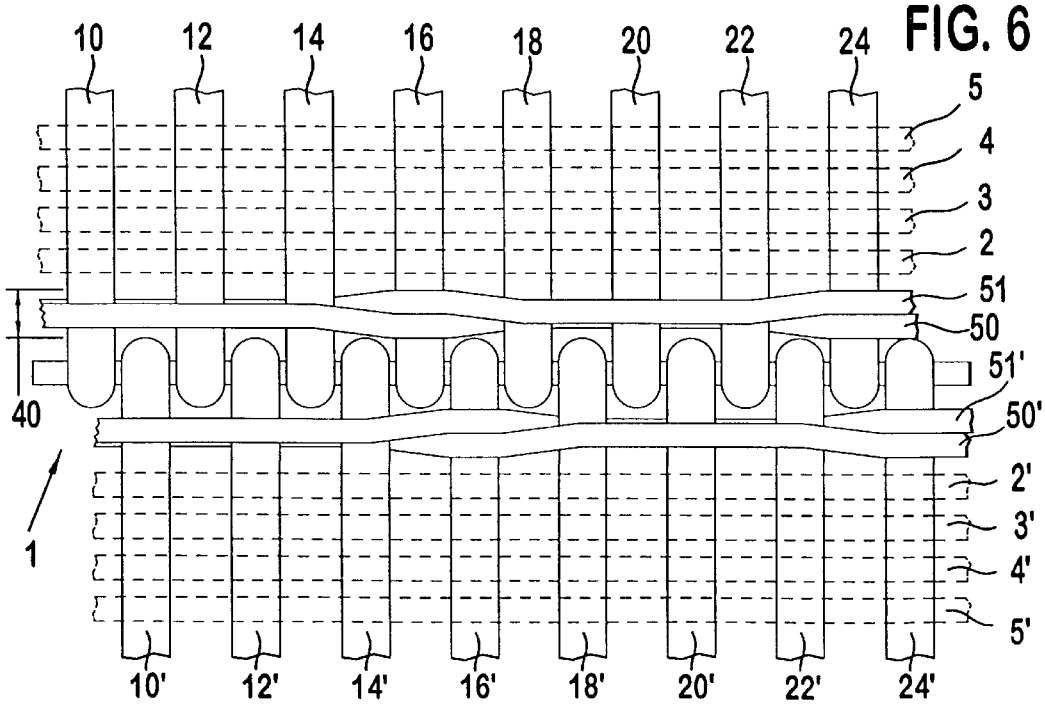

PAPERMAKING FABRIC SEAM WITH ADDITIONAL THREADS IN THE SEAM AREA

This application claims the benefit of: U.S. Provisional Application Ser. No. 60/098,547, filed Aug. 31,1998; U.S. Provisional Application Ser. No. 60/097,831, filed Aug. 31, 1998; U.S. Provisional Application Ser. No. 60/098,566, filed Aug. 31, 1998; U.S. Provisional Application Ser. No. 60/098,567, filed Aug. 31, 1998; and U.S. Provisional Application Ser. No. 60/098,573, filed Aug. 31, 1998.

BACKGROUND

The present invention generally relates to an open ended, woven fabric which is designed for use in a papermaking, cellulose or board manufacturing machine. The fabric has a plurality of loops at each end to form a seam for rendering the fabric endless.

As will be known to those skilled in the art, papermaking machines generally include three sections commonly referred to as the forming, press and dryer sections. The present invention finds particular application in the press section of a papermaking machine.

Typically, press felts include a supporting base, such as a woven fabric, and a paper carrying or supporting layer. Frequently, the paper support layer is a homogeneous, nonwoven batt that has been affixed to the base. Base fabrics are typically woven fabrics which are used as an endless loop. Such an endless loop fabric may be woven endless with no seam or the fabric may be woven with two ends which are joined by a seam. Typical seams include pin type seams which utilize a pintle inserted through seam loops to close the fabric.

Some prior art seams have employed threads in the seam area to increase batt adhesion. However, these efforts have not always produced the desired contact area and the desired interconnection between paper and machine side machine direction threads.

As a result of the seam loop construction, there exists a need to provide increased surface contact in the seam zone for better batt anchorage and a balance between the paper and machine sides.

SUMMARY

The present invention relates to an open ended papermaker's fabric of a type woven from a longitudinal thread system and a transverse thread system. A plurality of seam loops are formed at each end of the fabric by the threads of the longitudinal thread system. A seam zone exists at each end of the fabric between the respective seam loops and the last thread of the transverse thread system. At least one additional transverse thread is interwoven in at least one seam zone with the longitudinal thread system in a repeated pattern of over at least three adjacent paper side longitudinal threads, between at least one pair of threads, under at least one machine side longitudinal thread, and between another pair of threads.

BRIEF DESCRIPTION OF THE DRAWINGS

FIG. 5 is a top plan view of the two ends of the fabric of FIG. 1 prior to joining together thereof.

FIG. 6 is a top plan view of the two ends of the fabric of FIG. 1 joined together.

DESCRIPTION OF THE PREFERRED EMBODIMENTS

Figure 1:
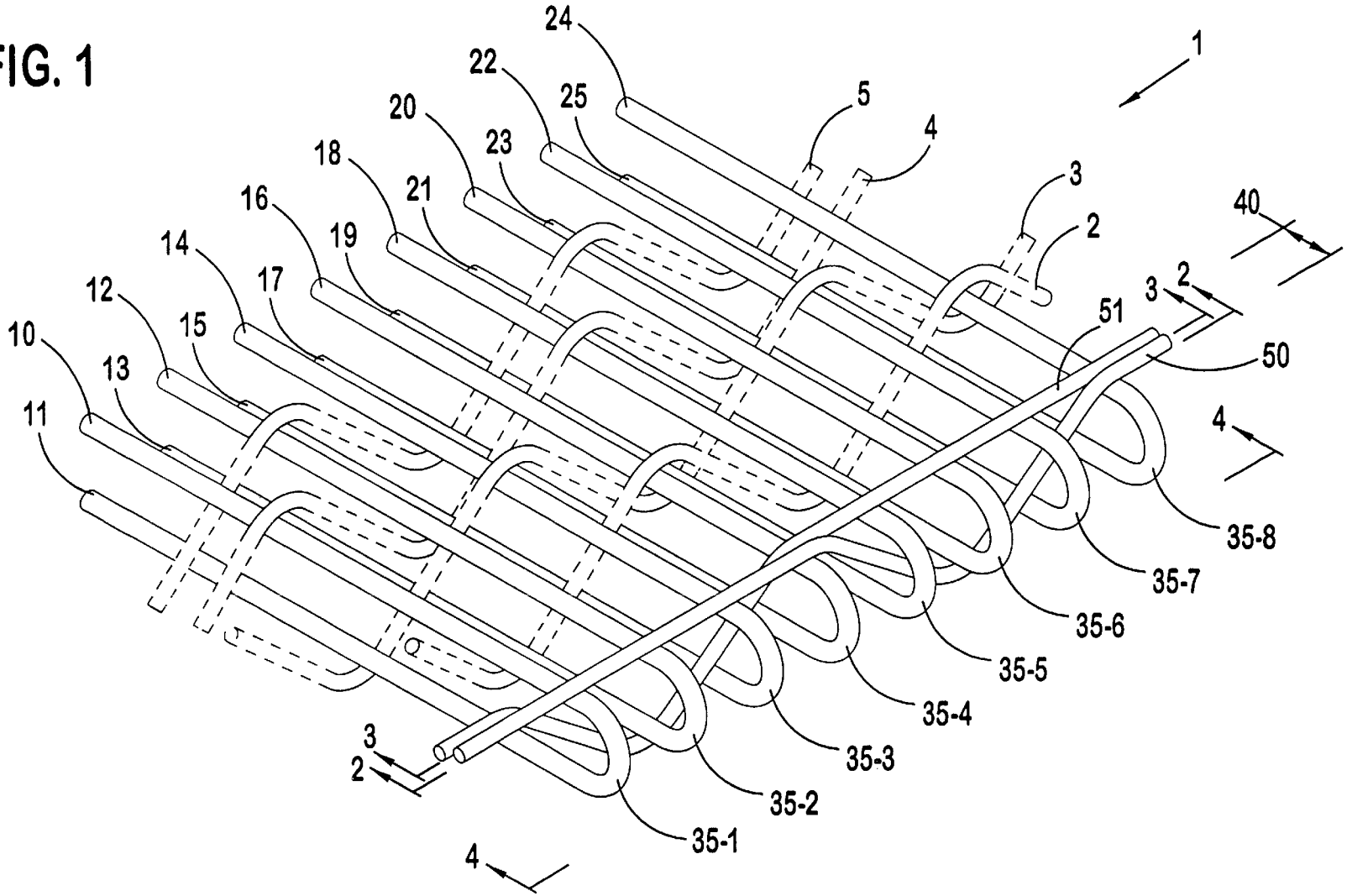
FIG. 1 is a schematic perspective view of a portion of one end of the base fabric of a first embodiment of the present invention.

The preferred embodiments will be described with reference to the drawing figures where like numerals represent like elements throughout.

Referring to FIG. 1, it shows a portion of one end of the base fabric seam loops with additional threads woven in accordance with a first embodiment of the present invention. The base fabric 1 comprises a top layer of MD threads, 10, 12, 14, 16, 18, 20, 22, and 24, and a bottom layer of MD threads, 11, 13, 15, 17, 19, 21, 23 and 25. It will be understood that the top and bottom layers are essentially continuous threads which form the seam loops 35-1 to 35-8 between the top and bottom layers.

Typically, the body CMD threads 2–5, shown in phantom, are interwoven with the top and bottom MD thread layers in a given repeat pattern to form the body of the base fabric 1. A seam zone 40 exists between the end CMD thread 2 and the seam loops 35-1 to 35-8. The weave pattern of the body CMD threads 2–5 can be varied to provide the desired characteristics of the base fabric 1.

Figure 2:
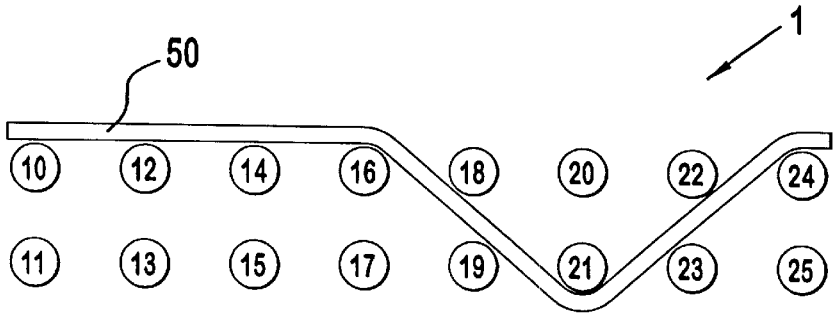
FIG. 2 illustrates one weave repeat pattern for one of the additional threads of the fabric of FIG. 1.
Figure 3:
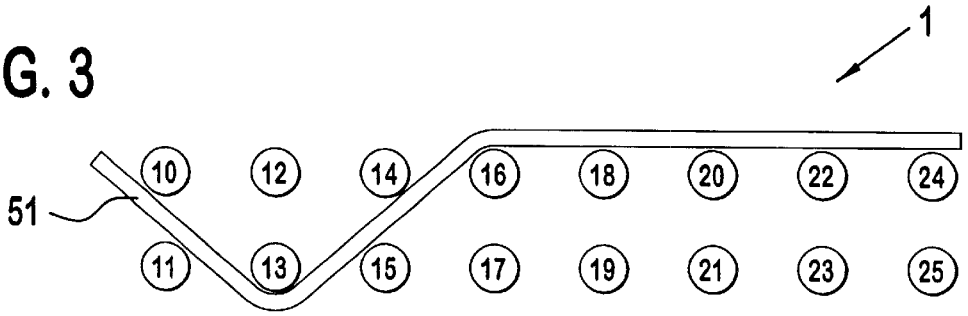
FIG. 3 illustrates one weave repeat pattern for the second additional thread of FIG. 1.
Figure 4:
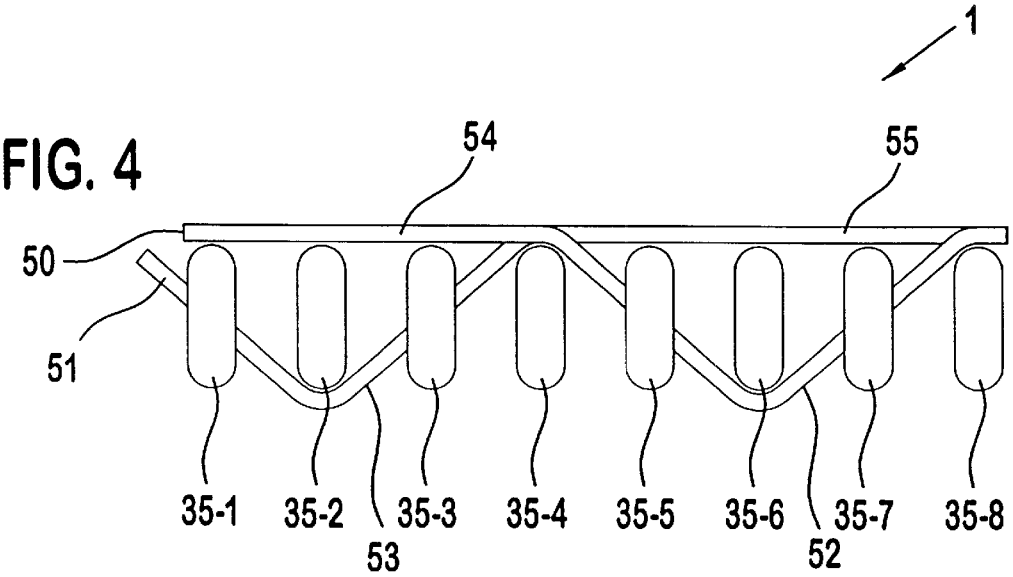
FIG. 4 is an elevation view of the fabric taken along line 4—4 in FIG. 1.
Figure 7:
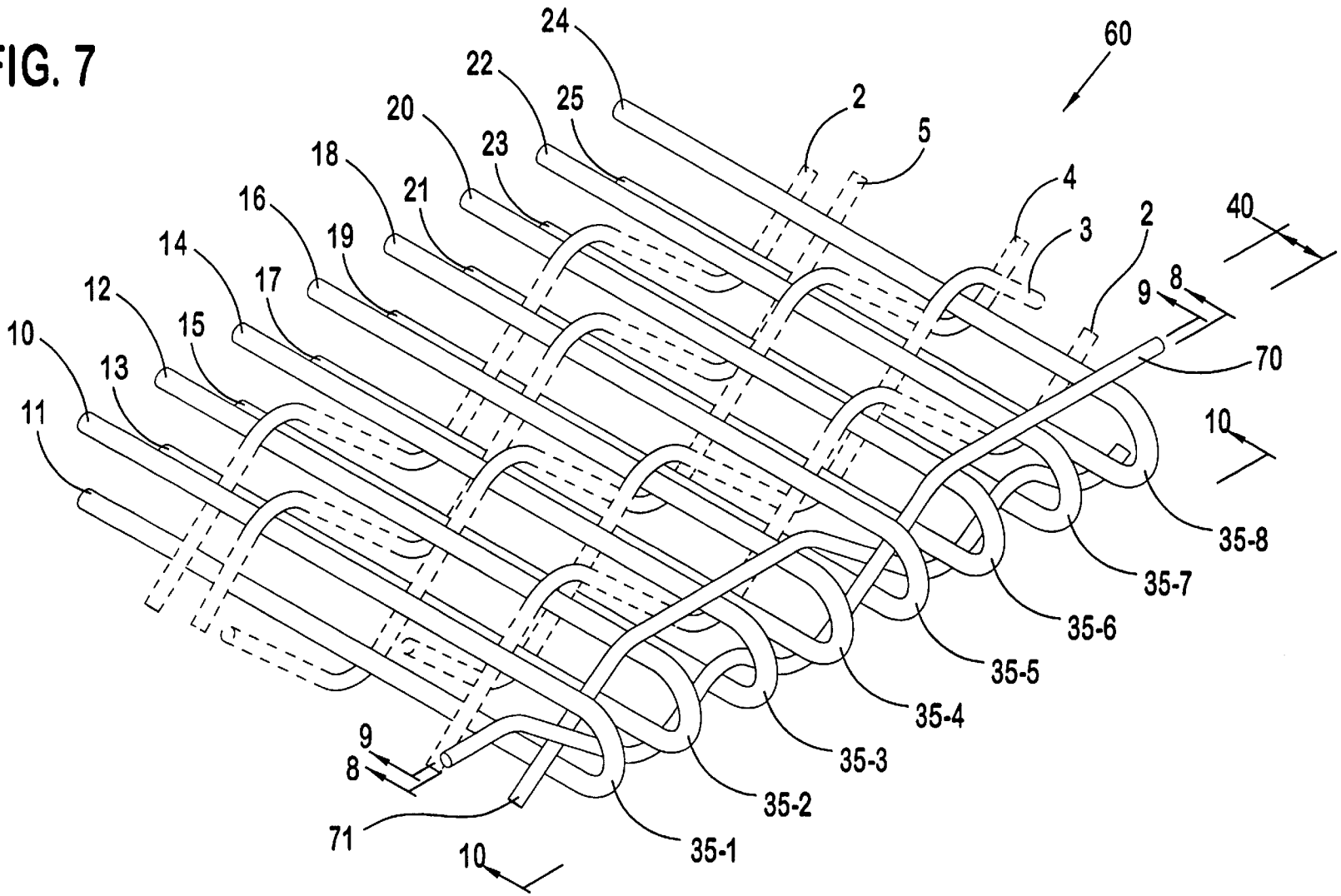
FIG. 7 is a schematic perspective view of a portion of one end of the base fabric of a second embodiment of the present invention.
Figure 8:
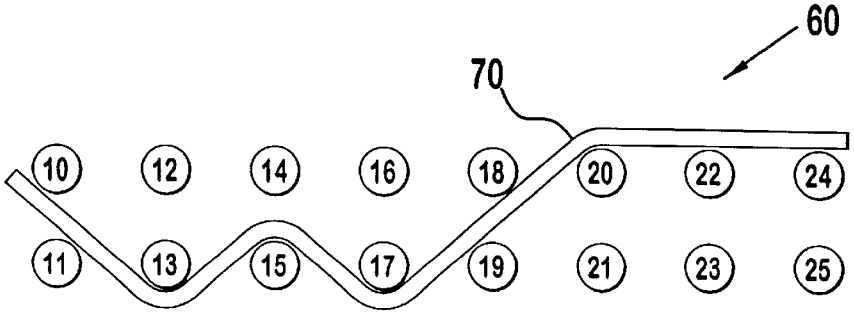
FIG. 8 illustrates one weave repeat pattern for one of the additional threads of the fabric of FIG. 7.

Reference is now made to FIGS. 2–4. Although some benefits will be obtained with a single thread, in the preferred embodiments, two additional threads are used for more uniformity in the paper side surface. Additionally, the additional threads may be provided along only one end of the fabric if desired in a particular application. The fabric will be described in terms of the preferred embodiments wherein two additional threads are provided at each end of the fabric.

The two additional CMD threads 50 and 51 are interwoven in the seam zone 40 with both layers of MD threads 10 through 25. As shown in FIG. 2, one additional CMD thread 50 preferably weaves in a repeat that passes over MD threads 10–17, between threads 18–19, under threads 20–21, between threads 22–23 and over threads 24–25. With reference to FIG. 3, the second additional thread 51 is woven in a repeat pattern which is shifted four MD thread pairs compared to that of thread 50. Thus, CMD thread 51 weaves in a repeat that passes between the pair of threads 10–11, beneath the threads of pair 12–13, between the pairs 14–15, and over threads 16–25. Each additional thread 50, 51 has a sheet side float 54, 55 of five top layer MD threads.

As can be seen from FIG. 4, two threads 50,51 woven in accordance with FIGS. 3 and 4 will produce a weave repeat structure wherein each machine side interlacing 52 and 53, respectively, is aligned with the paper side float 54 and 55 of the other additional thread 50, 51 respectively. As a result, the combined floats 54 and 55 float across each of the top layer MD threads 10,12,14,16,18,20,22,24 of the repeat. Since the repeat pattern extends over eight pairs of MD threads with minimal interlacing in the machine side MD layer, the paper side floats 54, 55 can shift slightly in the MD over the machine side interlacings 53, 52 of the other thread. As a result of the long floats 54, 55 and the interlacing patterns, the threads 50 and 51 can migrate relative to each other so that the seam zone 40 has effectively one long float across the width of the fabric. This result is illustrated in FIGS. 5 and 6. This effect may be further enhanced if the additional threads 50, 51 are selected from materials with no or low twist. Such material will allow the threads 50, 51 to flatten out in the float areas 54, 55 to cover more of the seam zone 40.

It is may be desirable, but not necessary, to weave the additional threads at the opposite ends of the fabric in reverse positioning with respect to each other. For example, as illustrated in FIG. 6, on one end of the fabric 1, additional thread 51 is adjacent the last CMD thread 2 and at the opposite end of the fabric 1, additional thread 50' is adjacent to the last CMD thread 2. This allows the two ends of the fabric 1 to complement each other when the fabric 1 is joined.

Figure 9:
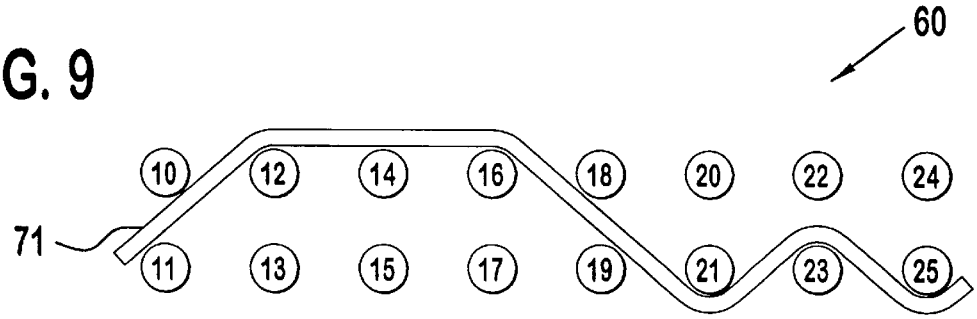
FIG. 9 illustrates one weave repeat pattern for the second additional thread of FIG. 7.
Figure 10:
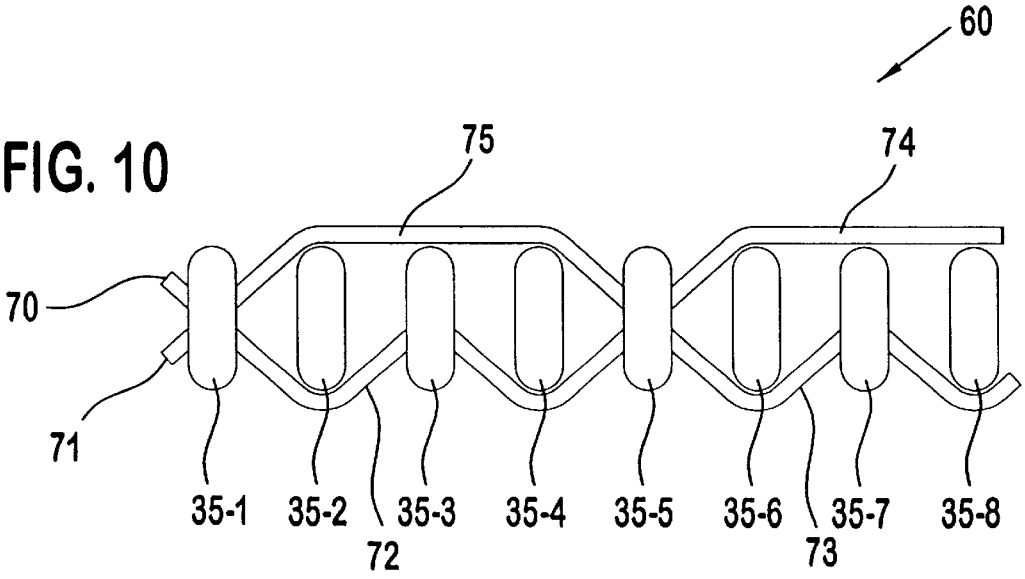
FIG. 10 is an elevation view of the fabric taken along line 10—10 in FIG. 7.
Figure 11:
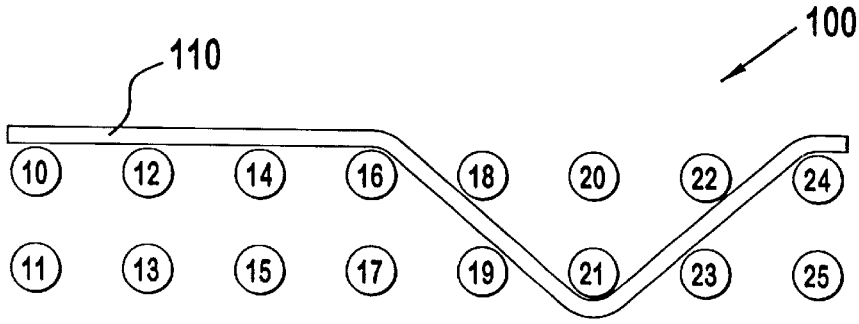
FIGS. 11–13 illustrate the weave repeat of the additional threads of a third embodiment of the present invention.
Figure 12:
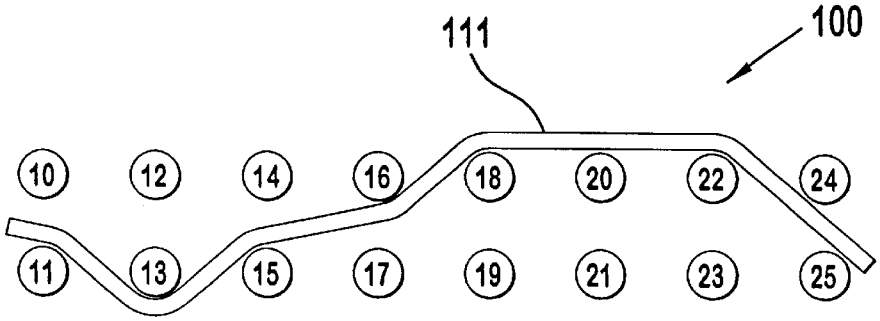

Referring to FIGS. 7–10, a second embodiment 60 which is similar to the first embodiment 1 is shown. In the second embodiment 60, one of the additional CMD threads 70 weaves between threads 10 and 11, under threads 12 and 13, between threads 14 and 15, under threads 16 and 17, transitions between threads 18 and 19, and over threads 20–25. The second additional thread 71 is again offset by four MD thread pairs. As shown in FIG. 9, it weaves between threads 10 and 11, over threads 12–17, transitions between threads 18 and 19, weaves under threads 20–21, between threads 22 and 23, and under threads 24 and 25. As shown in FIG. 10, the machine side interlacings 72 and 73 for each additional thread 70, 71 are aligned with the paper side float 74 and 75 of the other additional thread 70, 71 respectively. Although, there is slightly more interlacing points on the machine side MD layer, the paper side floats 54, 55 still shift with respect to one another to provide the seam zone 40 with repeating long float across the width of the fabric, as shown in FIGS. 11 and 12. The effective repeat with respect to the top layer MD threads 10,12,14,16,18,20, 22,24 of the combination of the threads is a pattern of over three and under one.

Figure 13:
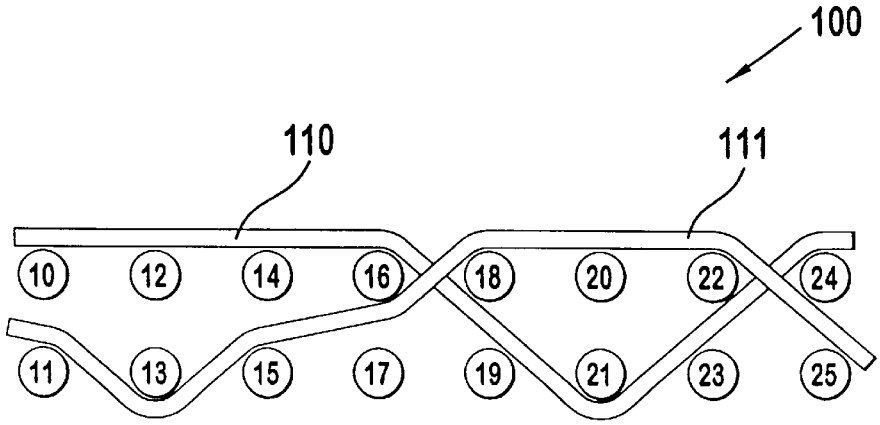
Figure 15:
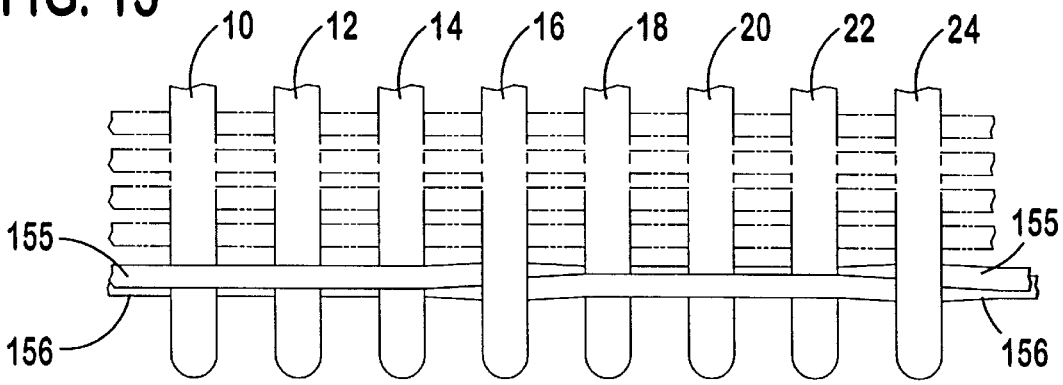
FIG. 15 a top plan view of one end of the fabric of the embodiment shown in FIG. 14.

A third embodiment 100 is disclosed with respect to FIGS. 11–13. Additional thread 110 is woven in the same manner as in FIG. 3 with respect to the first embodiment. The weave of additional CMD thread 111 is modified as depicted in FIG. 12. Thread 111 weaves between MD threads 10, 11, under MD threads 12 and 13, between MD threads 14, 15 and 16, 17, floats over MD threads 18, 20, 22 and between MD threads 24,25. Referring to FIG. 15, the effective long float over three of four top layer MD threads is maintained across the width of the fabric.

Figure 14:
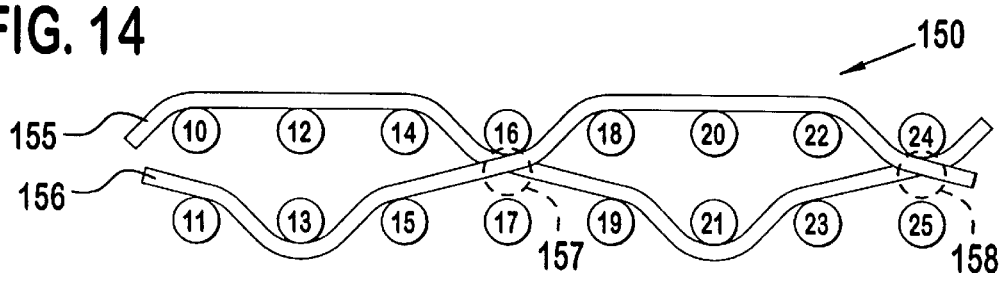
FIG. 14 illustrates the weave repeats of the additional threads of a fourth embodiment of the present invention.
Figure 16:
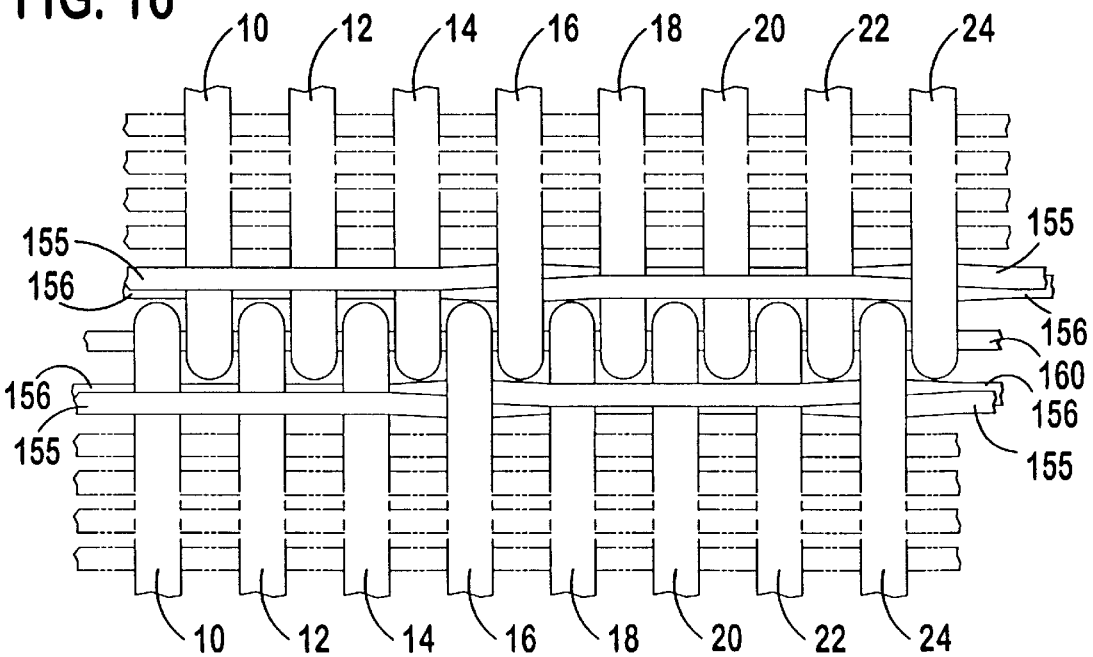
FIG. 16 shows a portion of the joined seam loops of the fabric of the embodiment shown in FIG. 14.

With reference to FIG. 14, there is shown a fourth embodiment 150. In this fourth embodiment 150, weave repeats of the CMD threads 155 and 156 result in floats over three machine direction threads 10, 12 and 14 and over three machine direction threads 18, 20, and 22. The long transition between pairs of machine direction threads and the interlacing with a single machine side MD thread per repeat is as previously described. Thus, the threads 155 and 156 will migrate relative to each other and produce an effective single thread with floats over three of four top layer MD threads 10,12,14,16,18,20,22,24. FIGS. 15 and 16 illustrate the migration of threads 155 and 156 in a manner similar to that described with respect to FIGS. 5 and 6.

Figure 17:
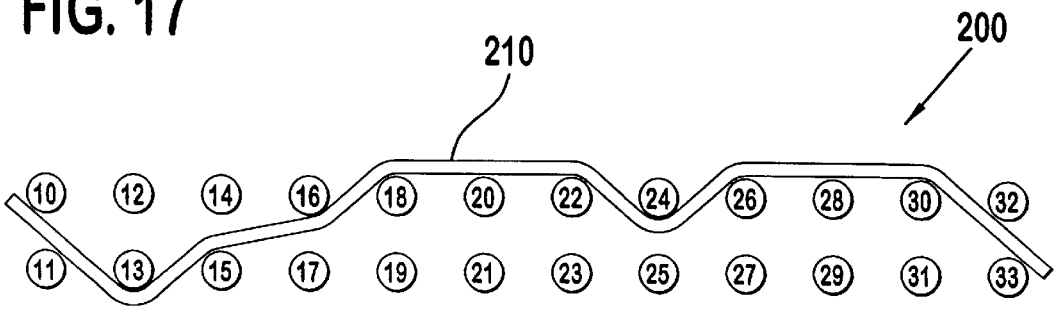
FIG. 17 illustrates one weave repeat pattern for one of the additional threads of a fifth embodiment of the present invention.
Figure 18:
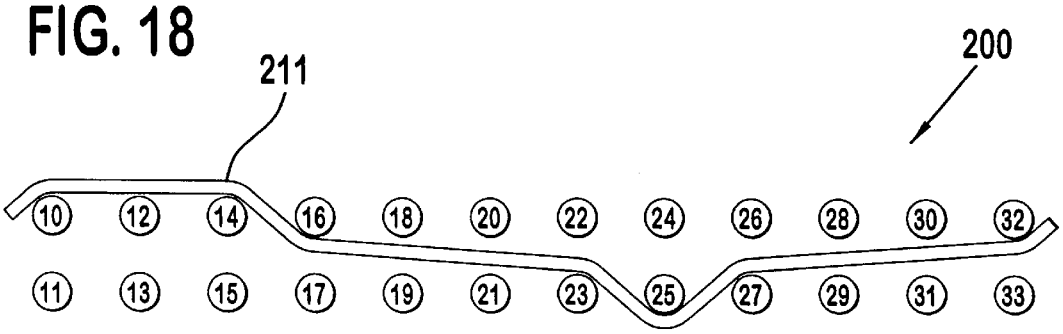
FIG. 18 illustrates one weave repeat for the second additional thread of the fabric of the fifth embodiment.
Figure 19:
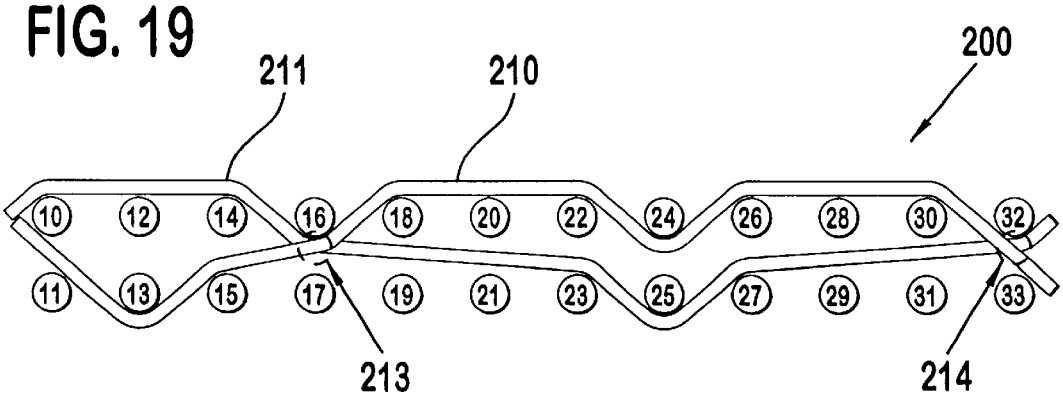
FIG. 19 shows the weave repeats of both additional threads of the fifth embodiment.

Referring to FIGS. 17–19, a fifth embodiment 200 is shown. The fabric 200 repeats on twenty four MD threads 10–33. The two additional threads 210 and 211 are interwoven in the seam zone 40 with both layers of longitudinal threads 10 through 33. Referring to FIG. 17, additional CMD thread 210 weaves in a repeat pattern that passes between MD threads 10–11, under MD threads 12–13, between MD thread pairs 14–15, 16–17, floats over MD threads 18–23, between MD threads 24–25, floats over MD threads 26–31 and between MD threads 32–33.

With reference to FIG. 18, the second additional thread 211 is woven in a complementary weave pattern to that of thread 210. Additional thread 211 weaves over MD threads 10–15, between MD thread pairs 16–17, 18–19, 20–21, 22–23, under MD threads 24–25 and between MD thread pairs 26–27, 28–29, 30–31, 32–33. It will be noted from FIG. 18 that additional thread 211 forms two mid-plane floats between four pairs of MD threads 16–33.

As can be seen from FIG. 19, the two additional threads 210–211 as interwoven in FIGS. 17 and 18 produce a weave repeat structure having the appearance of an over three, under one repeat in the upper layer. The two crossover points, 213, 214 are spaced apart by at least three MD threads. Since the repeat pattern extends over twelve pairs of MD threads with only a single interlacing in the machine side MD layer and the additional threads can shift relative to each other, threads 210 and 211 tend to act as one thread in a continuous three over, one under weave pattern on the top layer. With reference again to FIG. 17 and additional thread 210, it can be seen that the weave repeat of thread 210 includes a subrepeat of three over, one under which repeats twice within the pattern. This weave repeat permits the relatively loose interlacing of the thread 211, but enables the pattern to be continued throughout the upper layer when the threads 210, 211 are combined in accordance with FIG. 19.

It will be appreciated that batt adhesion to the additional thread(s) of the various embodiments will be most improved on the sheet side surface but that improved machine side batt adhesion will be achieved.

As explained above, the additional CMD threads 50, 51; 70, 71; 110, 111; 155, 156; and 210, 211 are preferably manufactured from materials with no or low twist, however, this is not required. The additional threads 50,51; 70,71; 110, 111; 155, 156; and 210,211 can be multifilament, spun, braided, knitted, or bicomponent. If the thread is of a bicomponent nature, the bicomponent material may have a core material with a higher melting point surrounded by a covering of a lower melting point material. This allows the covering to melt and adhere to the batt material during finishing without affecting the core structure of the thread. Threads may be made from polymeric resins selected from a group consisting of polyamide, polyurethanes, polyesters, polyaramids, polyimides, polyolefins, polyetherketones, polypropylenes, PET, PBT, PTT phenolics, and copolymers thereof.

What is claimed is:

1. An open ended papermaker's fabric of a type woven from a longitudinal thread system and a transverse thread system and having a paper side and a machine side, a plurality of seam loops at each end of the fabric formed by the threads of the longitudinal thread system whereby a seam zone is formed at each end of said fabric between the respective seam loops and a respective end thread of said transverse thread system, the fabric characterized by:

at least one additional transverse thread interwoven in at least one seam zone with the longitudinal thread system in a repeated pattern of over at least three adjacent paper side longitudinal threads, between at least a first pair of paper side and machine side threads, under at least one machine side longitudinal thread, and between at least a second pair of machine and paper side threads.

2. An open ended papermaker's fabric of a type woven from a longitudinal thread system and a transverse thread system and having a paper side and a machine side, a plurality of seam loops at each end of the fabric formed by the threads of the longitudinal thread system whereby a seam zone is formed at each end of said fabric between the respective seam loops and a respective end thread of said transverse thread system, the fabric characterized by:

two additional transverse threads interwoven in at least one seam zone with the longitudinal thread system, each of the two additional threads woven in a repeated pattern of over at least three adjacent paper side longitudinal threads to define at least a first paper side float, between at least a first pair of paper side and machine side threads, under at least one machine side longitudinal thread, and between at least a second pair of machine and paper side threads.

3. The fabric of claim 2 wherein the first paper side float of each additional thread is shifted in the transverse direction relative to the first paper side float of the other additional thread.

4. The fabric of claim 2 wherein the first paper side float of each additional thread is shifted in the transverse direction relative to the first paper side float of the other additional thread by at least four paper side longitudinal threads.

5. The fabric of claim 2 wherein the repeated pattern of one of the additional threads includes two paper side floats over at least three adjacent paper side longitudinal threads.

6. The fabric of claim 2 wherein the paper side floats of the first and second additional threads combine to float over at least seventy-five percent of the paper side longitudinal threads.

7. The fabric of claim 2 wherein the paper side floats of the first and second additional threads combine to float over each of the paper side longitudinal threads.

8. The fabric of claim 2 wherein the additional threads migrate relative to one another such that a portion of one of the additional threads overlies a portion of the other additional thread.

9. The fabric of claim 8 wherein the paper side floats of the first and second additional threads combine to float over each of the paper side longitudinal threads whereby a virtual continuous float over each of the paper side longitudinal threads is defined.

10. The fabric of claim 2 wherein the portion of one of the additional threads which defines that thread's first float weaves over a machine side longitudinal thread which the other additional thread weaves under.

11. The fabric of claim 2 wherein the portion of each additional thread which defines that the respective thread's first float weaves over a machine side longitudinal thread which the other additional thread weaves under.

12. A method of producing a papermaker's fabric comprising the steps of:

interweaving a longitudinal thread system with a transverse thread system to define a base fabric having first and second ends and a paper side and a machine side;

forming a plurality of seam loops at each end of the fabric from the threads of the longitudinal thread system and defining a seam zone at each end of said fabric between the respective seam loops and a respective end thread of said transverse thread system; and interweaving at least one additional transverse thread in at least one seam zone with the longitudinal thread system in a repeated pattern of over at least three adjacent paper side longitudinal threads, between at least a first pair of paper side and machine side threads, under at least one machine side longitudinal thread, and between at least a second pair of machine and paper side threads.

13. The method of claim 12 further comprising the step of interweaving a second additional transverse thread in the at least one seam zone with the longitudinal thread system in a repeated pattern of over at least three adjacent paper side longitudinal threads, between at least a first pair of paper side and machine side threads, under at least one machine side longitudinal thread, and between at least a second pair of machine and paper side threads.

* * * * *